United States Patent [19]

Onishi

[11] Patent Number: 4,854,835

[45] Date of Patent: Aug. 8, 1989

[54] PLUNGER PUMP

[75] Inventor: Keiichi Onishi, Itami, Japan

[73] Assignee: Sumimoto Electric Industries, Ltd., Osaka, Japan

[21] Appl. No.: 186,298

[22] Filed: Apr. 26, 1988

[30] Foreign Application Priority Data

Apr. 28, 1987 [JP] Japan ..... 62-64384

[51] Int. Cl.[4] ..... F04B 21/00

[52] U.S. Cl. ..... 417/435; 417/493; 417/502

[58] Field of Search ..... 417/435, 493, 502, 503

[56] References Cited

U.S. PATENT DOCUMENTS 1,699,194 1/1929 Junkers ..... 417/493

FOREIGN PATENT DOCUMENTS 363167 12/1931 United Kingdom ..... 417/493

*Primary Examiner*—Michael Koczo

*Attorney, Agent, or Firm*—Wenderoth, Lind & Ponack

[57] ABSTRACT

A plunger of a plunger pump is formed with an air vent passageway having its one end open to a compression chamber and the other end adapted to communicate with a reservoir space open to the atmosphere when the plunger comes near its top dead point. Air or gas trapped in the liquid sucked into the compression chamber will flow into the air vent passageway so as to be discharged into the reservoir space when the passageway gets into communication with it. Since air or gas is removed from the compression chamber, the pumping efficiency is prevented from decreasing.

1 Claim, 1 Drawing Sheet

PLUNGER PUMP

BACKGROUND OF THE INVENTION

The present invention relates to a plunger pump which solves the problem of a drop in pumping efficiency resulting from air or gas trapped in the sucked liquid staying in a compression chamber.

A prior art plunger pump is shown in FIG. 4 in which a plunger 1 has its one end projecting into a compression chamber 2 provided with an intake valve 3 and a discharge valve 4. The valves 3 and 4 have their respective ball-shaped valve bodies 3*a* and 4*a* which are biassed by springs 3*b* and 4*b* toward valve-closing positions with forces barely enough to keep the valves closed. In other words, the valve-opening pressure is set to a minimum.

Still, if the compression chamber 2 is filled with air or gas sucked in together with a liquid, it becomes difficult to increase and decrease sufficiently the pressure in the compression chamber to open the intake or discharge valve. In such a case, the pump efficiency may remarkably worsen or the pumping function may be totally lost. If the pump is provided with an accumulator in its discharge circuit, the gas such as nitrogen gas sealed in the accumulator might partially permeate through a partitioning rubber bladder to mix into the liquid. The leaked gas will find way through the discharge valve into the compression chamber and stick there. This may cause the accumulator to cease functioning.

With a side port type plunger pump in which an intake port is opened and closed according to the relative position of the plunger with respect to a pump case, the gas having flowed into the compression chamber is adapted to be carried back to a reservoir tank through an intake passage formed in the plunger. With this type of pump, in order to finish the sucking-up of liquid into the compression chamber within a limited time in its suction stroke, the intake passage has to have a sufficiently large sectional area. This results in a reduction in the effective stroke of the plunger, and thus in pumping power (or compression ratio).

SUMMARY OF THE INVENTION

An object of the present invention is to provide a high compression ratio plunger pump in which the gas mixed in the liquid will not stay in the compression chamber.

In accordance with the present invention, there is provided a plunger pump having a pump body, a compression chamber, an intake valve and a discharge valve mounted in the compression chamber, a reservoir space open to the atmosphere and a plunger reciprocably mounted in the pump body and having one end thereof projecting into the compression chamber and the other end projecting into the reservoir space, characterized in that the plunger is formed with a narrow air vent passage means having one end thereof open to the compression chamber and the other end adapted to communicate with the reservoir space only when the plunger comes near its top dead point.

The gas in the compression chamber will flow into the air vent passageway formed in the plunger, and when the plunger comes near its top dead point, will be discharged into the reservoir space communicating with the atmosphere.

The air vent passageway does not have to have so large a sectional area because it has to allow only gas to pass. The compression chamber is adapted to communicate with the reservoir space through the air vent passageway only when the plunger has come near to its top dead point. Thus, little loss in the effective stroke of the plunger results from the provision of the air vent passageway. The discharge efficiency is also kept high, since the gas will not stay in the compression chamber. The arrangement of the present invention can be advantageously applied to a hydraulic device actuated by an accumulator, too.

Other features and objects of the present invention will become apparent from the following description taken with reference to the accompanying drawings, in which:

DETAILED DESCRIPTION OF THE PREFERRED EMBODIMENT

Figure 1:
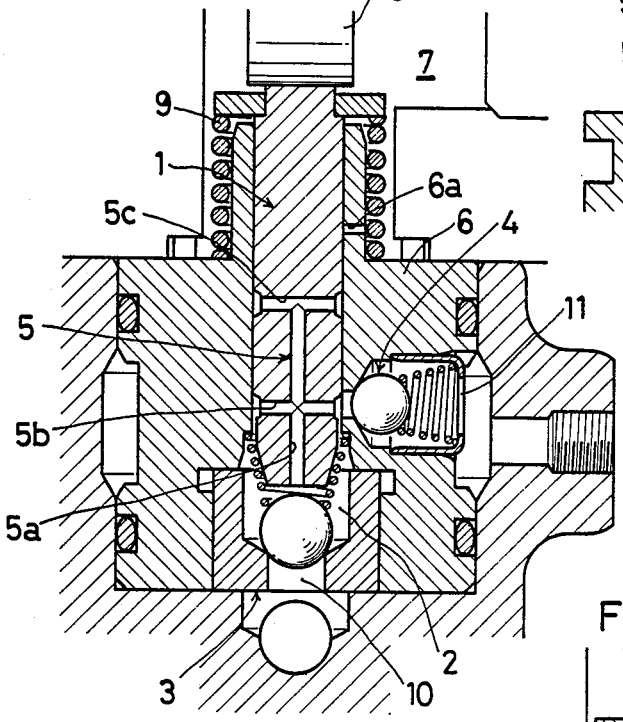
FIG. 1 is a sectional view of the preferred embodiment of the present invention.

FIG. 1 shows a preferred embodiment of the plunger pump according to the present invention in which a plunger 1 is formed with an air vent passageway 5 which comprises a vertical bore 5*a* having its bottom end open, a transverse hole 5*b* formed in the small-diameter portion of the plunger 1 at its uppermost position so as to communicate with the vertical bore 5*a*, and a second transverse hole 5*c* communicating with the top of the vertical bore 5*a* so that its openings at both ends will be closed up by the inner periphery of a pump case 6 when the plunger is at the position of FIG. 1. When the plunger 1 rises up to near to its top dead point, the second transverse hole 5*c* gets aligned with a small aperture 6*a* formed in the pump case 6 to allow the gas trapped in a compression chamber 2 to flow mainly through the transverse hole 5*b* into the vertical bore 5*a* and to be discharged into a reservoir space 7 open to the atmosphere. The plunger 1 has its top end projecting into the reservoir space 7.

In FIG. 1 numerals 8 and 9 designates a power transmission means such as an eccentric cam for giving a downward force to the plunger and a return spring for the plunger 1, respectively. An intake port 10 and a discharge port 11 are also provided.

Figure 2:
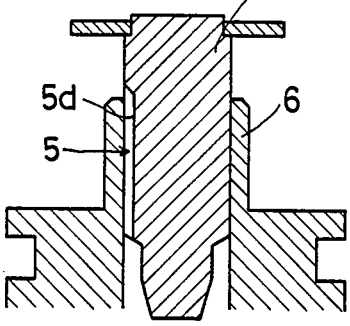
FIGS. 2 and 3 are sectional views of the plunger formed with other examples of air vent passageway.
Figure 3:
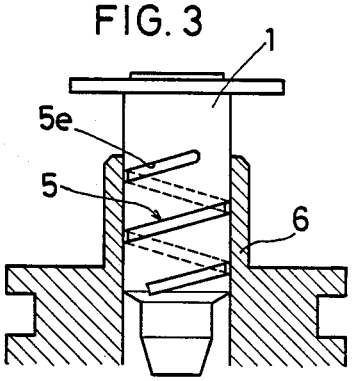
Figure 4:
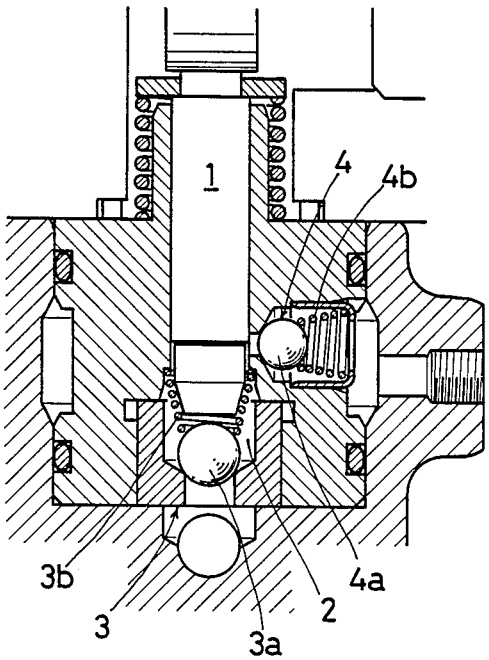
FIG. 4 PRIOR ART
FIG. 4 is a sectional view of a prior art plunger pump.

FIGS. 2 and 3 show variations of the passageway 5. In FIG. 2, the passageway 5 is in the form of an upright groove 5*d* and in FIG. 3 it is in the form of a spiral groove 5*e*. Both grooves 5*d* and 5*e* being formed in the outer periphery of the plunger 1. In either case, when the plunger 1 comes near its upper dead point, the passage 5 is adapted to have its top end open to the reservoir space 7 to put the compression chamber 2 into communication with the reservoir space 7.

What is claimed is:

1. A plunger pump having a pump body, a compression chamber, an intake valve and a discharge valve mounted in said compression chamber, a reservoir space open to the atmosphere and a plunger reciprocably mounted in said pump body and having one end thereof projecting into said compression chamber and the other end projecting into said reservoir space characterized in that said plunger is formed with a narrow air vent passage means having one end thereof open to said compression chamber and the other end adapted to communicate with said reservoir space only when said plunger comes near its top dead point.

* * * * *